United States Patent [19]

Dugard

[11] Patent Number: 5,039,106

[45] Date of Patent: Aug. 13, 1991

[54] GOLF BALL APPARATUS FOR TRAINING, PRACTICE AND ENTERTAINMENT

[76] Inventor: John R. Dugard, 6257 Solway Dr., Memphis, Tenn. 38119

[21] Appl. No.: 670,974

[22] Filed: Mar. 18, 1991

[51] Int. Cl.[5] ..... A63B 69/36

[52] U.S. Cl. ..... 273/199 A; 273/58 K

[58] Field of Search ..... 273/199 R, 199 A, 198, 273/200 R, 200 A, 200 B, 58 C, 184 B, 185 C

[56] References Cited

U.S. PATENT DOCUMENTS

| | | | |
|---|---|---|---|
| 1,555,124 | 9/1925 | Lambert | 273/198 |
| 3,147,979 | 9/1964 | Wolfe | 273/199 A |
| 3,627,326 | 12/1971 | Berry | 273/183 C |
| 3,697,081 | 10/1972 | Peyroux | 273/199 A |
| 4,014,553 | 3/1977 | Sakamoto | 273/200 R |
| 4,088,319 | 5/1978 | Clarke | 273/58 R |
| 4,662,639 | 5/1987 | Bonotto | 273/183 C |

*Primary Examiner*—George J. Marlo
*Attorney, Agent, or Firm*—Walker & McKenzie

[57] ABSTRACT

A golf ball apparatus including a golf ball having an aperture therethrough, and a drag for being attached to the golf ball and for restricting the distance the golf ball will travel after being hit. The drag includes an elongated, flexible cord having a first end portion extending through the aperture through the golf ball, having a second end portion extending through the aperture through the golf ball, and having a midportion joining the first and second end portions. The golf ball apparatus includes a first retainer for preventing the first end portion of the cord from being pulled from the aperture through the golf ball, and a second retainer for preventing the second end portion of the cord from being pulled from the aperture through the golf ball.

10 Claims, 1 Drawing Sheet

GOLF BALL APPARATUS FOR TRAINING, PRACTICE AND ENTERTAINMENT

BACKGROUND OF THE INVENTION

1. Field of the Invention

The present invention relates, in general, to a golf ball apparatus.

2. Information Disclosure Statement

The game of golf is normally played on a large, spacious course and takes a considerable amount of time to complete. Because of the structure of the game of golf, three major problems arise in obtaining practice to play: space, time, and cost.

A preliminary patentability search conducted in class 273, subclasses 199A, 58K, 35 and 184 produced the following patents: Lambert, U.S. Pat. Nos. 1,555,124; Wolfe, U.S. Pat. No. 3,147,979; Berry, U.S. Pat. 3,627,326; Peyroux, U.S. Pat. No. 3,697,081; Sakamoto, U.S. Pat. No. 4,014,553; Clarke, U.S. Pat. No. 4,088,319; and Bonotto, U.S. Pat. No. 4,662,639.

As indicated by the above patents, many apparatuses for allowing a golfer to practice a golf stroke in a confined area have been patented. These apparatuses may be divided generally into two broad categories: anchor apparatuses which secure golf balls to support structures by elongated tethers, and free-flight apparatuses which allow free but shortened flight of golf balls.

Lambert, Sakamoto, and Bonotto disclose anchor-type golf practice apparatuses. Lambert discloses a golf practice apparatus including a teeing platform to which a tethered or captive golf ball is attached by a spring. Sakamoto discloses a combined golf ball tether and anchor structure including an upright standard for being supported on a support surface from which a golf ball may be driven, a low horizontally outwardly projecting arm stationarily supported from the lower end portion of the standard at an elevation spaced above the lower end of the standard, an elongated flexible tether member anchored at one end to the outer free end of the arm, and a ball simulating a golf ball anchored to the other end of the tether member. Bonotto discloses a golf training device including a body member arranged to lie flat on a golf practice area, an elongated tether line extending freely through a longitudinal passageway through the body member, a first golf ball secured to one end of the tether line, and a second golf ball secured to the other end of the tether line.

Wolfe, Berry, and Peyroux disclose free-flight golf practice apparatuses. Wolfe discloses a practice golf ball assembly including a golf ball and a parachute attached to the golf ball to impede the ball during flight. Berry discloses a golf practice device consisting of a plurality of streamers secured to a golf ball for restricting the free flight thereof. The streamers are attached to the ball by a single length of cord, having one of its ends secured to a pair of parallel cords and having its other end secured to the ball. The streamers are secured to the pair of parallel cords. Peyroux discloses a golf training device including a standard golf ball and an aerodynamic braking member secured thereto by means of a flexible tie. Incorporated in the braking member is a substantially rigid support member with a head integral therewith for receiving the golf ball before the golf ball is hit.

Clarke discloses a ball with a tail of flexible plastic foam by which the ball may be thrown or caught. The tail trails the ball in flight and is of cross section great enough to prevent wrapping around or tangling with tree limbs, wires, etc., with which the tail may come in contact during flight.

None of the above patents disclose or suggest the present invention. More specifically, none of the above patents disclose or suggest a golf ball apparatus including, in general, a golf ball having an aperture therethrough; drag means for being attached to the golf ball and for restricting the distance the golf ball will travel after being hit; the drag means including an elongated, flexible cord having a first end portion extending through the aperture through the golf ball, having a second end portion extending through the aperture through the golf ball, and having a midportion joining the first and second end portions; first retainer means for preventing the first end portion of the cord from being pulled from the aperture through the golf ball; and second retainer means for preventing the second end portion of the cord from being pulled from the aperture through the golf ball.

SUMMARY OF THE INVENTION

The present invention is directed toward providing an improved golf ball apparatus. The present invention provides a golf ball apparatus for use in the training, practice and entertainment of golf, etc.

One objective of the present invention is to provide a golf ball apparatus that can be used to improve a golfer's swing and allow the golfer to "groove" his or her swing.

Another objective of the present invention is to provide a golf ball apparatus that allows a normal full swing to be made with all irons and woods.

Another objective of the present invention is to provide a practice golf ball apparatus which allows normal contact with a regular, regulation ball and allows the golfer to point his or her golf club head at the target.

Another objective of the present invention is to provide a golf ball apparatus which provides the opportunity to practice realistic golf and is like being on a real, full size golf course even when used in a small area.

Another objective of the present invention is to provide a golf ball apparatus which, due ro the restricted flight of the ball, allows practice to be accomplished in one-fourth of the usual area.

Another objective of the present invention is to provide a golf ball apparatus which provides a smooth even flight only when the ball is hit with a good, proper golf swing. This allows the golfer to tell when the ball is hit correctly and feel when correct contact has been made with the golf ball.

Another objective of the present invention is to provide a golf ball apparatus which helps a golfer to analyze his or her whole golf swing. By analyzing what was done, the golfer can improve his or her golf game and play and will realize when he or she has done something wrong such as not keeping his or her head down or his or her eyes on the golf ball, or gripping the club too tight, or pushing, lifting up and pulling across the golf ball, etc.

Another objective of the present invention is to provide a golf ball apparatus which allow- the golfer to slow down his or her swing to help the golfer to concentrate on the golf ball.

Another objective of the present invention is to provide a golf ball apparatus which requires no preparation prior to beginning practice. The ball can simply be dropped on the ground and positioned for hitting by using the head of a golf club. This allows practice to be begun in seconds.

Another objective of the present invention is to provide a golf ball apparatus which does not require a backstop or net to stop the ball.

Another objective of the present invention is to provide a golf ball apparatus which makes it easy to keep up with the golf ball, even in the rough.

Another objective of the present invention is to provide a golf ball apparatus which can be easily picked up with the head of a golf club without bending or stooping.

Another objective of the present invention is to provide a golf ball apparatus which, due to the simplicity of construction and the small amount and type of material used in construction, is extremely low in cost and will last for hundreds of hits.

Another objective of the present invention is to provide a golf ball apparatus which can be used to warm up before playing a regular round of golf.

Another objective of the present invention is to provide a golf ball apparatus which makes practice fun and entertaining.

Another objective of the present invention is to provide a golf ball apparatus which requires very little storage space after use.

The golf ball apparatus of the present invention includes, in general, a golf ball having an aperture therethrough; drag means for being attached to the golf ball and for restricting the distance the golf ball will travel after being hit; the drag means including an elongated, flexible cord having a first end portion extending through the aperture through the golf ball, having a second end portion extending through the aperture through the golf ball, and having a midportion joining the first and second end portions; first retainer means for preventing the first end portion of the cord from being pulled from the aperture through the golf ball; and second retainer means for preventing the second end portion of the cord from being pulled from the aperture through the golf ball.

DESCRIPTION OF THE PREFERRED EMBODIMENT

Figure 1:
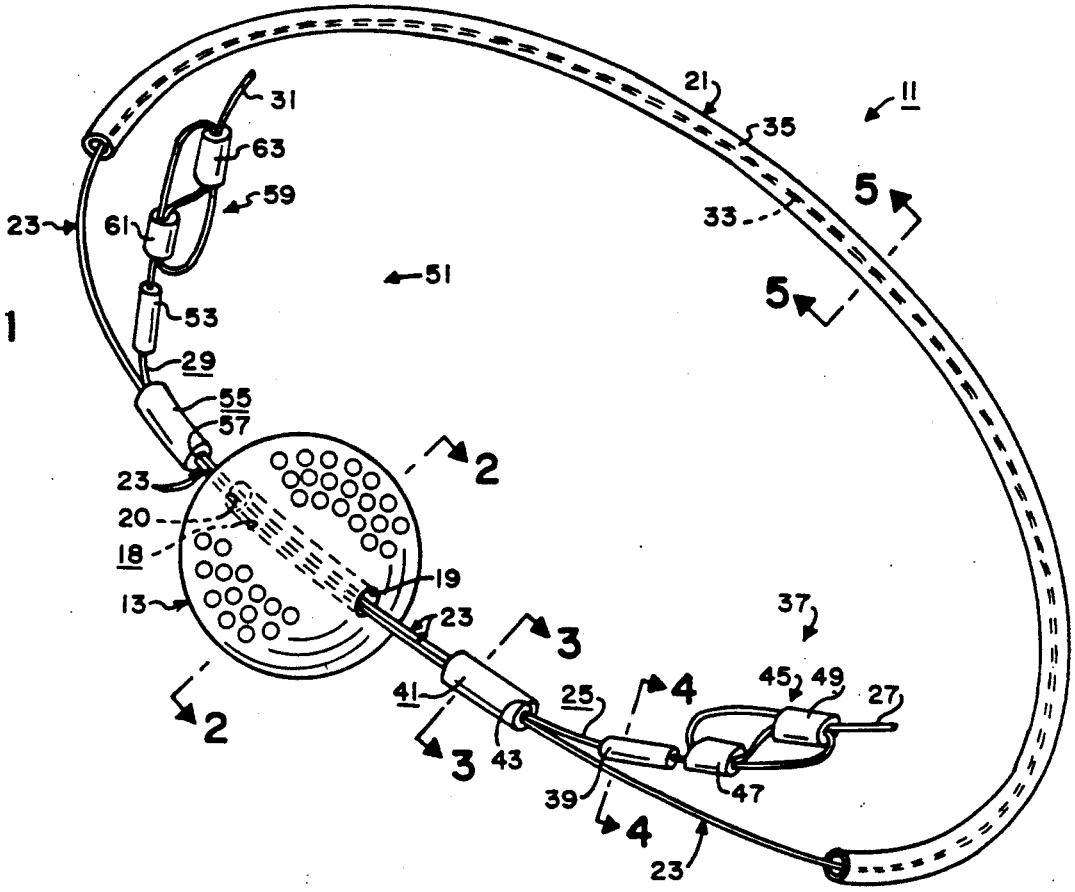
FIG. 1 is a perspective view of the golf ball apparatus of the present invention.
Figure 2:
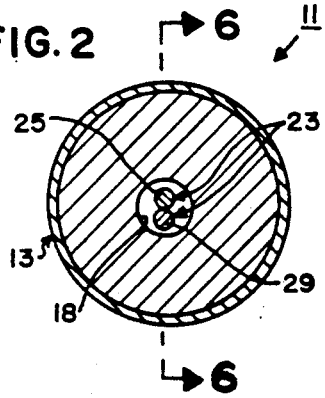
FIG. 2 is a sectional view substantially as taken on line 2—2 of FIG. 1.
Figure 3:
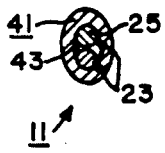
FIG. 3 is an enlarged sectional view substantially as taken on line 3—3 of FIG. 1.
Figure 4:
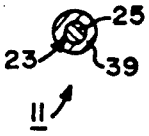
FIG. 4 is an enlarged sectional view substantially as taken on line 4—4 of FIG. 1.
Figure 5:
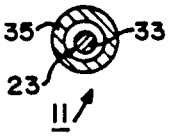
FIG. 5 is an enlarged sectional view substantially as taken on line 5—5 of FIG. 1.

The preferred embodiment of the golf ball apparatus of the present invention is shown in FIGS. 1-6 and identified by the numeral 11. The apparatus 11 is used to assist with the training, practice, and entertainment of golf.

The apparatus 11 includes a golf ball 13 for being hit with the head of a standard golf club (not shown) in any conventional manner. The golf ball 13 is a solid composition regulation golf ball modified to have an aperture 18 therethrough. The aperture 18 has a first end 19 and a second end 20. The aperture 18 is preferably diametrically arranged and is preferably drilled or otherwise formed completely through the center of the golf ball 13 having a diameter of 5/32 inch.

The apparatus 11 includes drag means 21 for being attached to the golf ball 13 and for restricting the distance the golf ball 13 will travel after being hit. The drag means 21 includes an elongated, flexible cord 23 extending through the aperture 18 in the golf ball 13. The cord 23 includes a first end portion 25 having a distal end 27, a second end portion 29 having a distal end 31, and a midportion 33 joining the first and second end portions 25, 29. The cord 23 preferably consists of an approximately 3 foot length of flexible plastic line with a diameter of approximately 0.080 inches. Such plastic line is typically used with many string-type grass trimmers (e.g., a Weed Eater® brand grass trimmer). The distal ends 27, 31 of the end portions 25, 29 of the cord 23 are preferably heat sealed so they will not split or fray as will now be apparent to those skilled in the art.

The first end portion 25 of the cord 23 extends through the aperture 18 with the distal end 27 thereof located outward of the first end 19 of the aperture 18. The second end portion 29 of the cord 23 extends through the aperture 18 with the distal end 31 thereof located outward of the second end 20 of the aperture 18. Thus, as clearly shown in FIGS. 1, 2 and 6, the cord 23 overlaps in the aperture 18. However, as clearly shown in FIGS. 2 and 6, the diameter of the aperture 18 is sufficient as compared to the diameters of the overlapped cord 23 so that the golf ball 13 is free to slide back and forth between the first end portion 25 and the second end portion 29.

The drag means 21 preferably includes an elongated tube 35 positioned on the midportion 33 of the cord 23. The tube 35 preferably consists of an approximately 10 inch length of plastic tubing having an outside diameter of $\frac{1}{4}$ inch and an inside diameter of $\frac{1}{8}$ inch. As clearly shown in FIG. 5, the diameter of the aperture through the tube 35 is thus sufficiently large when compared to the diameter of the midportion 33 of the cord 23 so that the tube 35 is free to slide back and forth on the midportion 33 of the cord 23.

The apparatus 11 includes a first retainer means 37 for preventing the first end portion 25 of the cord 23 from being pulled from the aperture 18 of the golf ball 13. The first retainer means 37 includes means attached to the first end portion 25 of the cord 23 for stopping the distal end 27 thereof from passing through the aperture 18 of the golf ball 13. More specifically, the first retainer means 37 includes a stop means 39 fixedly attached to the first end portion 25 of the cord 23 and a sleeve member 41 positioned on the first end portion 25 of the cord 23 between the golf ball 13 and the stop means 39.

Figure 6:
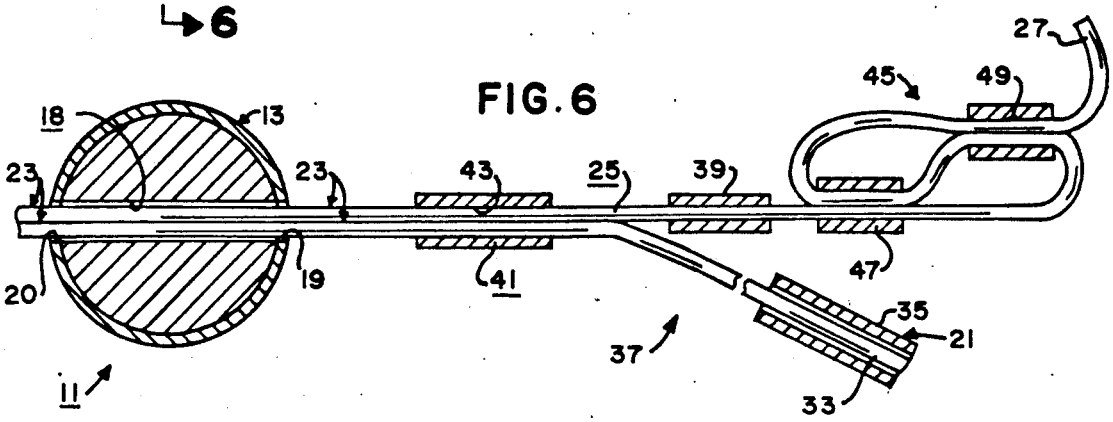
FIG. 6 is a somewhat diagrammatic sectional view substantially as taken on line 6—6 of FIG. 2 of a portion of the golf ball apparatus of the present invention showing the golf ball and the first retainer.

The sleeve member 41 preferably has an aperture 43 therethrough for tightly receiving the cord 23 twice, as the first and second portions 25, 29 enter from opposite ends and pass through the sleeve member 41 (see FIGS. 1 and 6). The sleeve member 41 preferably consists -f an approximately one inch length of plastic tubing having an outside diameter of $\frac{1}{4}$ inch and an inside diameter of $\frac{1}{8}$ inch. As clearly shown in FIG. 3, the diameter of the aperture 43 is preferably such when compared to the combined diameters of twice that of cord 23 that the sleeve member 41 will slide back and forth when substantial force is applied. The diameter of the sleeve member 41 is larger than the diameter of the aperture 18 through the golf ball 13 and, therefore, the sleeve member 41 will not pass through the aperture 18 of the golf ball 13.

The stop means 39 stops the distal end 27 of the first end portion 25 of the cord 23 from passing back through the aperture 43 of the sleeve member 41. The stop means 39 preferably has a cross sectional diameter that is larger than the cross sectional diameter of the aperture 43 through the sleeve member 41. The stop means 39 preferably consists of a length of rubber tape ¾ inch wide and 4 inches long attached to and wrapped about the first end portion 25 of the cord 23.

The first retainer means 37 preferably includes a cinch means 45 for being attached to the first end portion 25 of the cord 23 adjacent the distal end 27 thereof. The cinch means 45 preferably includes a first tube 47 and a second tube 49 with the first end portion 25 of the cord 23 extending first through the first tube 47, then through the second tube 49, then back through the fir-t tube 47, and then back through the second tube 49 as clearly shown in FIGS. 1 and 6. All possible slack in the cord 23 between the stop means 39 and the distal end 27 is removed by forcing the first tube 47 and the second tube 49 into the stop means 39 and pulling outward on the distal end 27. When tubes 47, 49 have been pushed and pulled into position, the tubes 47, 49 will not move and the cinch is completed. The cinch means 45 securely locks the stop means 39 in place. Therefore, the golf ball 13 cannot be knocked or pulled off the first distal end 27. The first and second tubes 47, 49 preferably consist of approximately ½ inch length of plastic tubing having an outside diameter of ¼ inch and an inside diameter of ⅛ inch.

The apparatus 11 includes a second retainer means 51 for preventing the second end portion 29 of the cord 23 from being pulled from the aperture 18 of the golf ball 13. The second retainer means 51 includes means attached to the second end portion 29 of the cord 23 for stopping the distal end 31 thereof from passing through the aperture 18 of the golf ball 13. More specifically, the second retainer means 51 includes a stop means 53 fixedly attached to the second end portion 29 of the cord 23 and a sleeve member 55 positioned on the second end portion 29 of the cord 23 between the golf ball 13 and the stop means 53.

The sleeve member 55 preferably has an aperture 57 therethrough for tightly receiving cord 23 twice, as the first and second portions 25, 29 enter from opposite ends and pass through the sleeve member 55 (see FIG. 1). The sleeve member 55 preferably consists of an approximately one inch length of plastic tubing having an outside diameter of ¼ inch and an inside diameter of ⅛ inch. The diameter of the aperture 57 is preferably such when compared to the combined diameters of twice that of cord 23 that the sleeve member 55 will slide back and forth on the cord 23 when substantial force is applied thereto. The diameter of the sleeve member 55 is larger than the diameter of the aperture 18 through the golf ball 13 and, therefore, the sleeve member 55 will not pass through the aperture 18 of the golf ball 13.

The stop means 53 stops the distal end 31 of the second end portion 29 of the cord 23 from passing back through the aperture 57 of the sleeve member 55. The stop means 53 preferably has a cross sectional diameter that is larger than the cross sectional diameter of the aperture 57 through the sleeve member 55. The stop means 53 preferably consists of a length of rubber tape ¾ inch wide and 4 inches long attached to and wrapped about the second end portion 29 of the cord 23.

The second retainer means 51 preferably includes a cinch means 59 for being attached to the second end portion 29 of the cord 23 adjacent the distal end 31 thereof. The cinch means 59 preferably includes a first tube 61 and a second tube 63 with the second end portion 29 of the cord 23 extending first through the first tube 61, then through the second tube 63, then back through the first tube 61, and then back through the second tube 63 as clearly shown in FIG. 1. All possible slack between the stop means 53 and the distal end 31 is removed by forcing the first tube 61 and the second tube 63 into the stop means 53 and pulling outward on the distal end 31. When the tubes 61, 63 have been pushed and pulled into position, the tubes 61, 63 will not move and a cinch is completed. The cinch securely locks the stop means 53 in place. Therefore, the golf ball 13 cannot be knocked or pulled off the second distal end 31. The first tube 61 and the second tube 63 preferably consist of approximately ½ inch length of plastic tubing having an outside diameter of ¼ inch and an inside diameter of ⅛ inch.

To use the golf ball apparatus 11 of the present invention, the size of the loop or ring formed by the drag means 21 is adjusted so as to vary the amount of drag applied to the golf ball 13. The size of the ring can be adjusted to each individual golfer's preference for hitting. The ring can be made larger by pulling on the golf ball 13 and tube 35 in opposite directions and can be made smaller by pulling on the first and second terminal or distal ends 27, 31 in opposite directions. The golf ball apparatus 11 is then merely placed on the ground or other surface from which it is to be hit. While the layout of the golf ball apparatus 11 is not critical, it is preferred that the golf ball apparatus 11 be laid out so that the ring formed by the drag means 21 is located comparatively flat on the ground and the golf ball 13 is between the golfer and the drag means 21.

As thus constructed and used, the golf ball apparatus 11 provides an attachment to a regulation golf ball that alters the normal flight of the golf ball when hit by a regulation golf club by restricting the distance the ball normally travels, for example, seventy-five per cent to thereby overcome a main problem of routine golf practice of not having sufficient space in which to practice. Thus, for example, while a regular golf ball may travel 200 yards when hit under certain conditions and in a certain manner, the golf ball apparatus 11 may be adjusted to only travel 50 yards when hit under the same conditions and in the same manner. The present invention thus provides an inexpensive, compact, easy to use device for the training, practice and entertainment of golf that provides a realistic golf feel. The golf ball apparatus 11 will make a smooth, even flight when the golf ball 13 is hit by a correct golf swing and proper contact is made between the head of the golf club and the golf ball 13.

Although the present invention has been described and illustrated with respect to a preferred embodiment and a preferred use therefor, it is not to be so limited since modifications and changes can be made therein which are within the full intended scope of the invention.

I claim:

1. A golf ball apparatus comprising:

a) a golf ball having an aperture therethrough;

b) drag means for being attached to said golf ball and for restricting the distance said golf ball will travel after being hit; said drag means including an elongated, flexible cord having a first end portion extending through said aperture through said golf ball, having a second end portion extending through said aperture through said golf ball, and having a midportion joining said first and second end portions;

c) first retainer means for preventing said first end portion of said cord from being pulled from said aperture through said golf ball; and d) second retainer means for preventing said second end portion of said cord from being pulled from said aperture through said golf ball.

2. A golf ball apparatus comprising:

a) a standard golf ball having a diametrically arranged aperture completely therethrough, said aperture having a first end and a second end;

b) drag means for being attached to said golf ball and for restricting the distance said golf ball will travel after being hit; said drag means including an elongated, flexible cord extending through said aperture of said golf ball; said cord including a first end portion having a distal end, including a second end portion having a distal end, and including a midportion joining said first and second end portions; said first end portion of said cord extending through said aperture of said golf ball with said distal end thereof located outward of said first end of said aperture of said golf ball; said second end portion of said cord extending through said aperture of said golf ball with said distal end thereof located outward of said second end of said aperture of said golf ball; said drag means including an elongated tube slidably positioned on said midportion of said cord;

c) first retainer means for preventing said first end portion of said cord from being pulled from said aperture of said golf ball; said first retainer means including means attached to said first end portion of said cord for stopping said distal end of said first end portion of said cord from passing through said aperture of said golf ball; and d) second retainer means for preventing said second end portion of said cord from being pulled from said aperture of said golf ball; said second retainer means including means attached to said second end portion of said cord for stopping said distal end of said second end portion of said cord from passing through said aperture of said golf ball.

3. The golf ball apparatus of claim 2 in which said first retainer means includes stop means fixedly attached to said first end portion of said cord and includes a sleeve member positioned on said first end portion of said cord between said golf ball and said stop means of said first retainer means; and in which said second retainer means includes stop means fixedly attached to said second end portion of said cord and includes a sleeve member positioned on said second end portion of said cord between said golf ball and said stop means of said second end portion.

4. The golf ball apparatus of claim 4 in which said sleeve member of said first retainer means has a cross sectional diameter that is larger than the cross sectional diameter of said aperture through said golf ball for preventing said first retainer means from passing through said aperture through said golf ball; and in which said sleeve member of said second retainer means has a cross sectional diameter that is larger than the cross sectional diameter of said aperture through said golf ball for preventing said second retainer means from passing through said aperture through said golf ball.

5. The golf ball apparatus of claim 4 in which said sleeve member of said first retainer means has an aperture therethrough for tightly receiving said first and second end portions of said cord; and in which said sleeve member of said second retainer means has an aperture therethrough for tightly receiving said first and second end portions of said cord.

6. The golf ball apparatus of claim 5 in which said first retainer means includes cinch means for being attached to said first end portion of said cord adjacent said distal end of said first end portion of said cord; and in which said second retainer means includes cinch means for being attached to said second end portion of said cord adjacent said distal end of said second end portion of said cord.

7. The golf ball apparatus of claim 6 in which said cinch means of said first retainer means includes a first tube and a second tube with said first end portion of said cord extending first through said first tube, then through said second tube, then back through said first tube, and then back through said second tube.

8. The golf ball apparatus of claim 7 in which all possible slack in said first end portion of said cord between said stop means of said first retainer means and said distal end thereof is removed.

9. The golf ball apparatus of claim 7 in which said cinch means of said second retainer means includes a first tube and a second tube with said second end portion of said cord extending first through said first tube, then through said second tube, then back through said first tube, and then back through said second tube.

10. The golf ball apparatus of claim 9 in which all possible slack in said second end portion of said cord between said stop means of said second retainer means and said distal end thereof is removed.

* * * * *